United States Patent [19]

Patterson

[11] Patent Number: 4,700,728

[45] Date of Patent: Oct. 20, 1987

[54] DEVICE FOR CLEANING PAINT ROLLERS

[76] Inventor: Charles E. Patterson, 1412 6th St., Berkeley, Calif. 94710

[21] Appl. No.: 771,611

[22] Filed: Sep. 3, 1985

[51] Int. Cl.[4] ..... B08B 3/02

[52] U.S. Cl. ..... 134/138; 248/113; 134/151

[58] Field of Search ..... 134/137, 138, 151, 153, 134/155, 141, 139, 51, 180, 140; 68/213; 248/113; 239/103, 73, 70, 71, 265; 222/41, 74

[56] References Cited

U.S. PATENT DOCUMENTS

| | | | |
|---|---|---|---|
| 1,633,803 | 6/1927 | Ballin | 134/144 X |
| 1,838,634 | 12/1931 | Peterson et al. | 134/172 |
| 2,116,935 | 5/1938 | Richard et al. | 239/265 X |
| 2,606,689 | 8/1952 | Kistner | 248/113 X |
| 2,674,391 | 4/1954 | Davis | 248/113 X |
| 2,855,123 | 10/1958 | Kintz | 248/113 X |
| 2,938,368 | 5/1960 | Bixel | 134/138 X |
| 3,389,797 | 8/1975 | Wright et al. | 134/138 X |
| 3,428,060 | 2/1969 | Spivey | 134/141 |
| 3,688,785 | 9/1972 | Stevens et al. | 134/138 |
| 3,818,529 | 6/1974 | Leggett | 134/138 X |
| 4,130,124 | 12/1978 | Sherwin | 134/138 |
| 4,266,746 | 5/1981 | Klaiber | 248/113 |
| 4,549,562 | 10/1985 | Ossi | 134/155 X |

FOREIGN PATENT DOCUMENTS

| | | | |
|---|---|---|---|
| 785642 | 5/1968 | Canada | 248/113 |
| 2716931 | 10/1978 | Fed. Rep. of Germany | 134/138 |
| 1159380 | 7/1969 | United Kingdom | 134/149 |

*Primary Examiner*—Harvey C. Hornsby
*Assistant Examiner*—Frankie L. Stinson
*Attorney, Agent, or Firm*—Bielen & Peterson

[57] ABSTRACT

A device for cleaning paint rollers having a handle and roll utilizing housing for enclosing the roll. The roll is mounted in the housing permitting rotation of the roll in relation to roller handle. A nozzle directs paint cleaning fluid to the rotatably mounted roll in the housing for removal of the paint from the roll.

2 Claims, 6 Drawing Figures

DEVICE FOR CLEANING PAINT ROLLERS

BACKGROUND OF THE INVENTION

The present invention relates to a novel device for cleaning a paint roller.

The advent of water based paints has fostered the use of the paint roller for application of paints on surfaces. Although, the paint roller permits the easy application of paint to surface they are often difficult to clean for reuse. Improper cleaning dictated the disposal of paint rollers after a single use in certain cases.

Attempts to clean a paint laden paint roller often required extensive manipulation by the user to squeeze paint from the roller. In short, cleaning a paint roller has been a time consuming task. Paint is often transferred from the roller to the user's hands and clothing in the process resulting in the necessity of secondary cleaning and the possibility of harm to the user's skin caused by contact with the paint.

A device for cleaning paint rollers would be a great advance in the industrial arts.

SUMMARY OF THE INVENTION

In accordance with the present invention a novel and useful device for cleaning paint rollers is described.

The device of the present application employs a housing for enclosing the roll portion of the paint roller. Means is employed for mounting the roll in the housing such that the roll may rotate in relation to the roller handle. Such mounting means may include a mounting surface on the housing and a clamp for supporting the handle of the paint roller outside the housing. The housing may be of many shapes as long as the roll of the paint roller is permitted to spin within the same. A pan or other catch basin may be placed below the housing and serve as a support for the housing. The clamp may be constructed to include means for rotating the handle supported in the clamp about an axis. A mounting surface of the housing serves as a fulcrum for rotation of the handle and the roll within the housing which is connected to the housing. Thus, rollers of different angular dimensions may be placed in the housing in a configuration most conducive to permitting the roll to spin within the housing. The clamp may externalize in a pair of plates disposed on opposite sides of the handle of the paint roller. One or more tensioning fasteners may span the pair of plates and pass through a slots in a third plate. Of course, the plates would include a pivot at the axis of rotation of the clamp.

Means is also included in the present invention for directing paint cleaning fluid to the rotatably mounted roll. Such cleaning fluid may be water, but could include other fluids where the paint is not water-based. The paint cleaning fluid directing means may be formed by a tube having a plurality of openings along a dimension thereof.

The invention further provides for means for filling the tube with paint cleaning fluid such that the plurality of openings in the tube serve as a nozzle or spray source which directs cleaning fluid to the roll in the housing. The tube would generally extend along an axis and may rotate in relation to that axis. Consequently, the spray or stream of cleaning fluid emanating from the tube may be directed at an angle to the roll mounted within the housing. Further, the angular disposition of the tube and the openings along the same may be locked into a position during operation. The housing may be provided with a cap to permit easy access to the interior of the housing.

It may be apparent that a novel and useful device for cleaning paint rollers has been described.

It is therefore an object of the present invention to provide a device for cleaning paint rollers which minimizes contact with the skin of the user.

It is another object of the present invention to provide a device for cleaning paint rollers which is compatible with a garden hose and utilizes water pressure from a municipal water system.

Another object of the present invention is to provide a device for cleaning paint rollers which employs centrifugal force and may be combined with a paint roller tray to also clean the latter.

Yet another object of the present invention is to provide a device for cleaning paint rollers of different sizes and shapes and at different rates.

The invention possess other objects and advantages especially as concerns particular characteristics and features thereof which will become apparent as the application continues.

Figure 1:
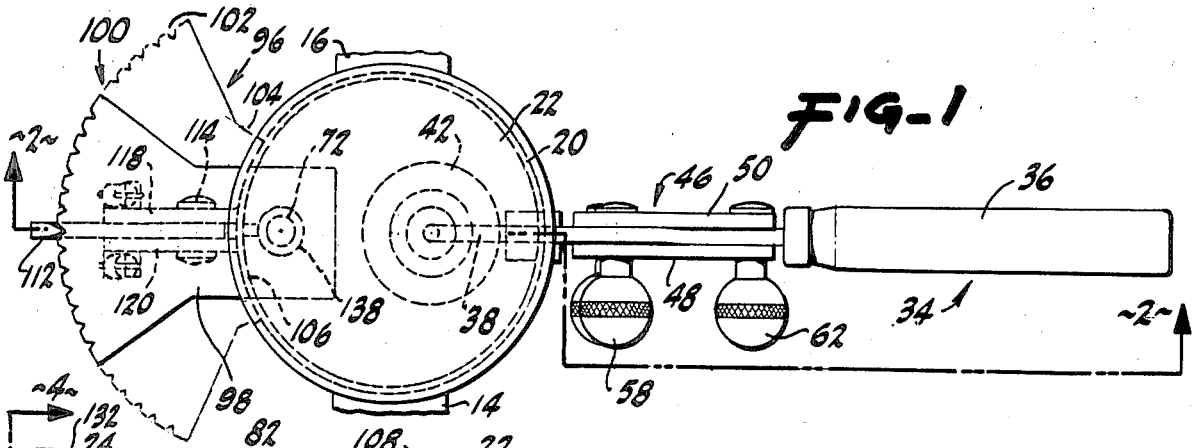
FIG. 1 is a top plan view of the invention.

For a better understanding of the invention reference is made to the hereinafter described description of the preferred embodiments thereof which should be referenced to the hereinabove described drawings.

DESCRIPTION OF THE PREFERRED EMBODIMENTS

Various aspects of the invention will evolve from the following detailed description of the preferred embodiments which should be referenced to the hereinabove described drawings.

The invention as a whole is shown in the drawings by reference character 10. The paint roller cleaning device 10 includes as one of its elements a housing 12 which may be supported by brackets 14 and 16 to a paint roller pan 18 (shown in phantom) FIGS. 2 and 3.

Figure 6:
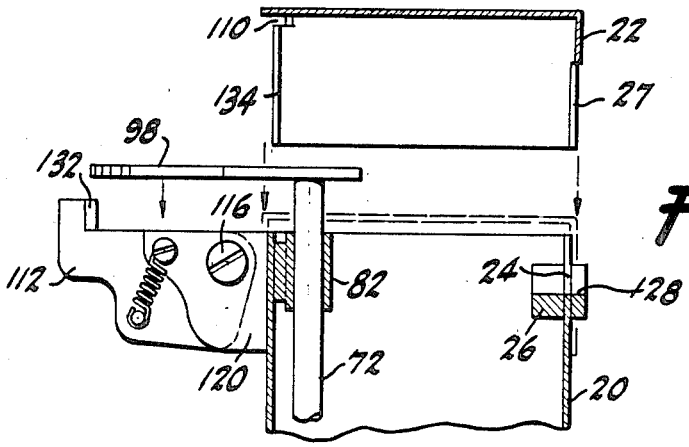
FIG. 6 is an exploded side view of the top portion of the device of the present invention.
Figure 3:
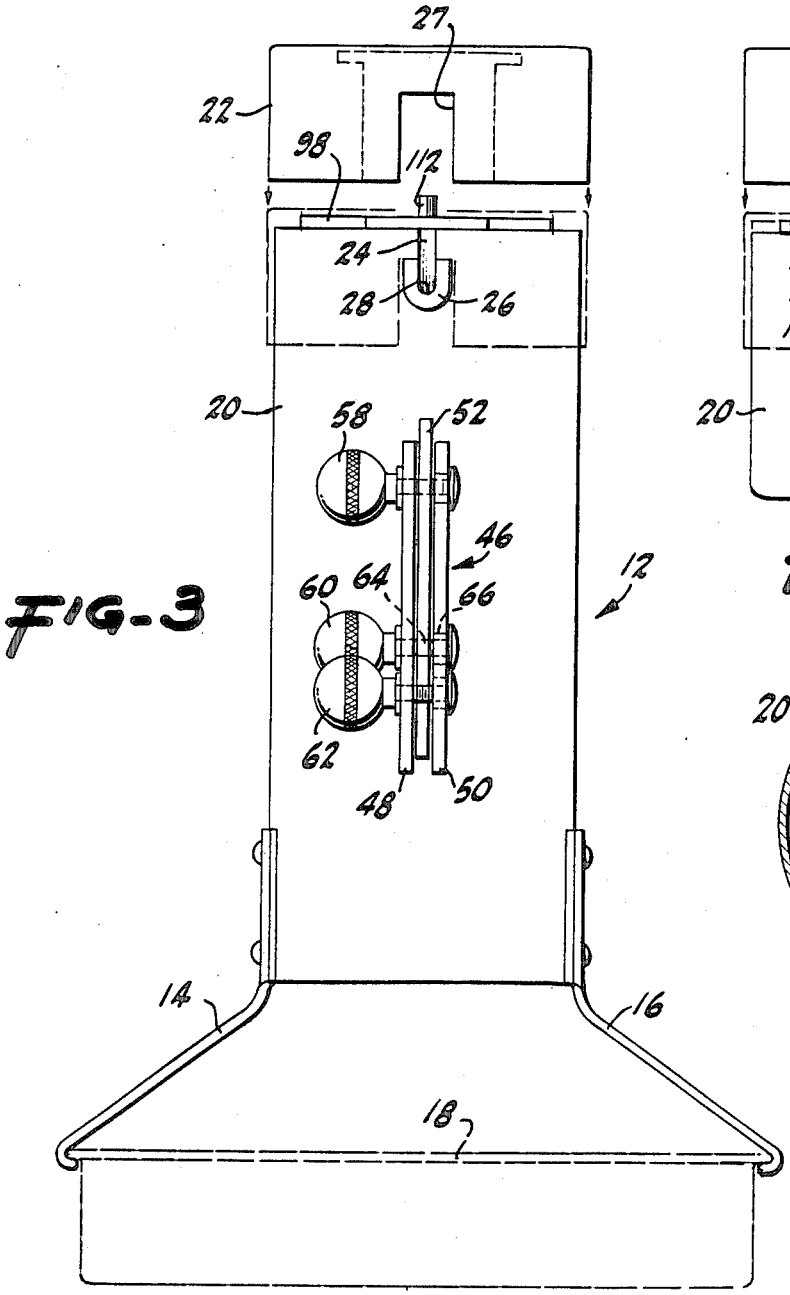
FIG. 3 is a right side view of the present invention in relation to the orientation of the device shown in FIG. 2.
Figure 4:
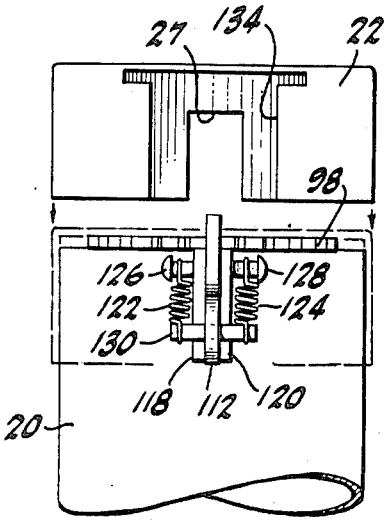
FIG. 4 is a sectional view taken along line 4—4 of FIG. 2.

Housing 12 may be constructed of any rigid or semi-rigid material such as plastic, metal, and the like. As depicted in the drawings, housing 12 is a cylindrical tube 20 having a top 22 which is removable from the cylindrical tube 20, FIGS. 3, 4 and 6. With reference to FIG. 3, it may be seen that tube 20 includes a notch 24 with a circular reinforcement 26. Top 22 includes a recess 27 to accommodate reinforcement 26 when top 22 fits over tube 20. The base 28 of reinforcement 26 and the base 30 of notch 24 serve as a mounting surface for paint roller 32. In this position, the roll 42 is free to rotate in relation to the handle 34 of paint roller 32.

Specifically, handle 34 of paint roller 32 includes a grip 36 and an angulated arm 38. Straight section 40 of arm 38 actually rest on the bases 28 and 30 of reinforcement 26 and notch 24, respectively. Roller 32 includes a roll 42 of paint absorbing material. It should be noted that roller 32 is commercially available and the embodiment depicted in the drawings is for the sake of illustration of the use of the device 10.

Figure 2:
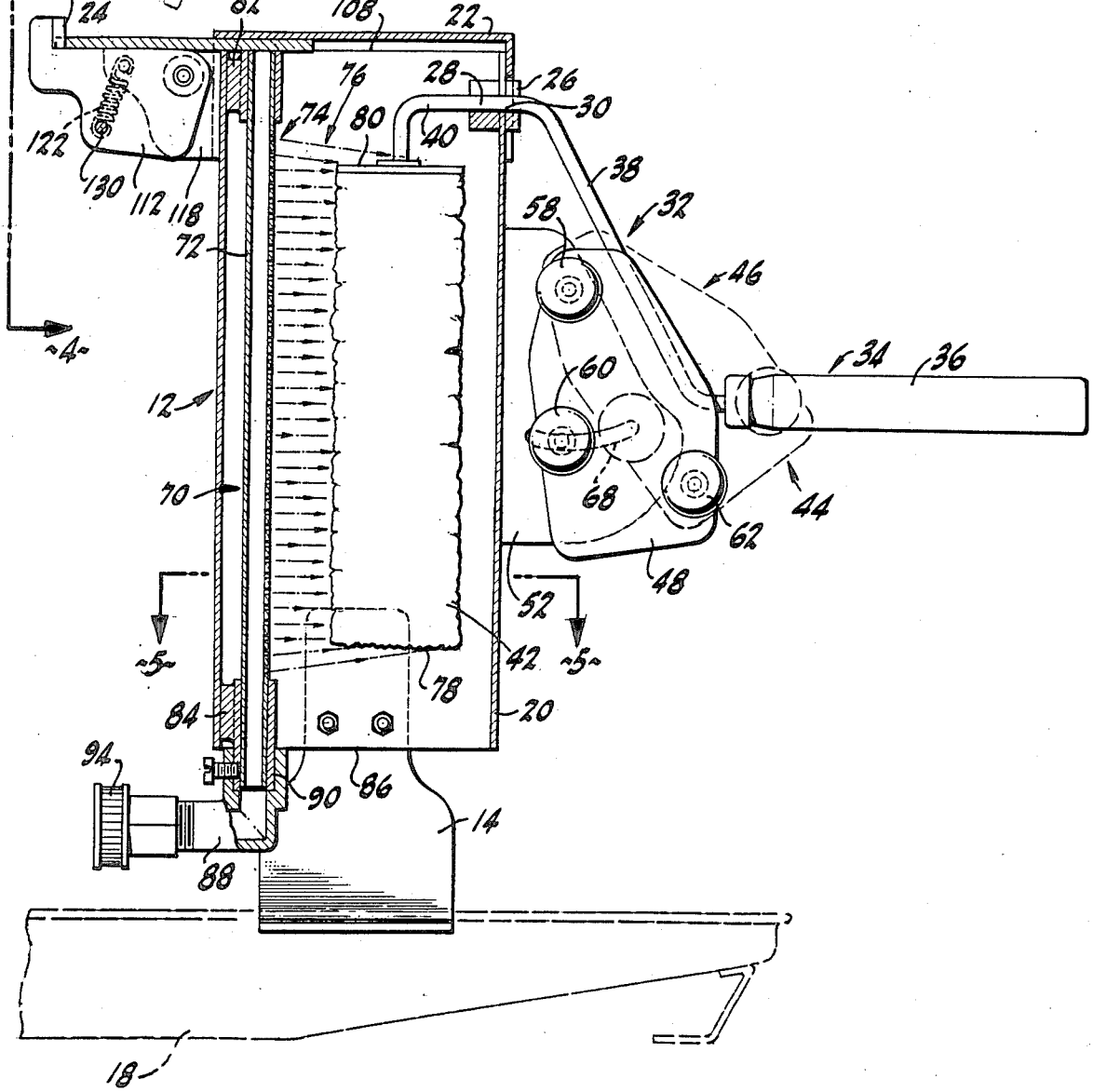
FIG. 2 is a sectional view taken along line 2—2 of FIG. 1.

Device 10 possesses means 44 for mounting roll 42 and housing 12. Means 44 may take the form of clamp 46 which is best shown in FIGS. 1, 2 and 3. Clamp 46 consists of plates 48, 50, and 52. Plate 52 is fixed to the external surface of tube 20. Plates 48 and 50 sandwich plate 52 and are movable in relation to plate 52. Tensioning fasteners 58, 60, and 62 span plates 48 and 50. Fastener 58 serves as a pivot and, thus, passes through plate 52. Fastener 60 passes through openings 64 and 66 in plates 48 and 50 respectively. In addition, fastener 60 rides along slot 68 found in plate 52. In essence, plates 48 and 50 may swing around the pivot formed by fastener 58 to hold handle 34 at various angular orientations. FIG. 2 depicts, in phantom, alternate positions for plate 48 and plate 50 therebehind (hidden from view). Arm 38 of handle 34 would pivot on the mounting surface formed by bases 28 and 30 of brackets 26 and notch 30.

Means 70 directs cleaning fluid to roll 42 for the purpose of removing paint therefrom. Means 70 may take the structure shown in the drawings and include a spray tube 72 having a plurality of openings 74 along its length. With reference to FIG. 2 it may seen that plurality of openings 74 create a stream or spray 76 of cleaning fluid against the roll 42. It should be noted, that the uppermost and bottommost streams of cleaning fluid are angled toward the ends 78 and 80 of roll 42. Spray tube 72 is held to the interior of tube 20 via bearings or bosses 82 and 84. Tube 72 extends below the bottom 86 of tube 20 and into an elbow 88 having an insert 90 in one portion thereof. A set screw 92 holds spray tube 72 to elbow 88. Hose fitting 94 permits the use of water as a cleaning fluid from a municipal water system. However, any cleaning fluid may be used in device 10.

Figure 5:
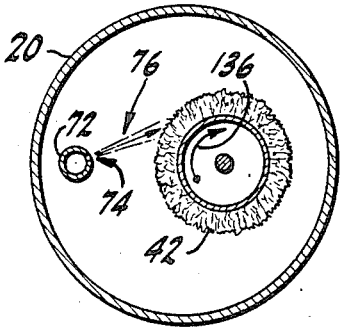
FIG. 5 is a sectional view taken along line 5—5 of FIG. 2.

Means 96 is also provided for axially turning spray tube 72 within housing 12. With reference to FIG. 1, it may be observed that spray tube 72 connects to a gauge plate 98 having a plurality of notches 100 along an arcuate edge 102 thereof. The neck portion 104, of gauge plate 98 moves within a recess 106 found at the upper end 108 of tube 20. Top 22 accommodates gauge plate 98 with a relieved portion 110, FIG. 6. Member 112 rotates about pivot 114 which includes a pin 116. Member 112 lies between a pair of supports 118 and 120 which are fixed to tube 20. Springs 122 and 124 are fastened to screws 126 and 128 as well as pin 130 which passes through supports 118 and 120, FIG. 4. Thus, member 112 rotates into position such that edge 132 is able to engage any of the plurality of notches 100 in gage plate 98. Cover 22 includes a recess 134, FIG. 4, to accommodate means 96. With reference to FIG. 5, the turning of spray tube 72 is illustrated such that the spray 76 contacts roll 42 with a tangential component. As a result, roll 42 is urged in a rotational path per directional arrow 136.

In operation, the user places the paint roller 32 in device 10 by resting arm 38 within the notch 24 of tube 20. Means 44 is employed to mount roll 42 in a convenient position within housing 12 by the use of clamp 46. Spray tube 72 is rotated about its long axis 138 to a position shown in FIG. 5. Paint cleaning fluid is directed through elbow 88 into spray tube 72 and a spray 76 exits spray tube 72 for impingement on roll 42. Roll 42 will then spin causing paint to move to the outer surface of roll 42 and to be washed therefrom by the stream or spray of paint cleaning fluid 76. The paint then drops to tray or pan 18 and flows therefrom into a proper draining facility. Brushes and other implements used in painting may be placed inside pan 18 and be washed clean at the same time that roll 42 is being cleaned. After roll 42 is cleaned it may be reused for painting or dried for use at a future date.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A device for cleaning a paint roller having a handle and a paint engaging roll comprising:

a. a housing for enclosing the roll;

b. means for mounting the roll in said housing, said roll mounting means permitting rotation of the roll in relation to the roller handle including a mounting surface provided by said housing and a clamp supporting the handle of the paint roller, said clamp further including means for rotation of said clamp and the handle supported therein about an axis, said mounting surface of said housing serving as a fulcrum for rotation of the handle and the roll within said housing connected thereto, a pair of plates disposed on opposite sides of said handle of said paint roller, and at least one tensioning fastener spanning said pair of plates, a third plate fixed in relation to said housing, said third plate including an elongated slot, said pair of plates including openings alignable with said third plate slot such that said tensioning fastener is movable along said slot and is capable of forcing said pair of plates toward said third plate;

c. means for directing paint cleaning fluid to the rotatably mounted roll in said housing.

2. The device of claim 1 which additionally comprises a pan, and means for holding said housing to said pan.

* * * * *